US005378963A

United States Patent [19]

Ikeda

[11] Patent Number: 5,378,963

[45] Date of Patent: Jan. 3, 1995

[54] FIELD EMISSION TYPE FLAT DISPLAY APPARATUS

[75] Inventor: Rikio Ikeda, Kanagawa, Japan

[73] Assignee: Sony Corporation, Tokyo, Japan

[21] Appl. No.: 188,736

[22] Filed: Jan. 31, 1994

Related U.S. Application Data

[63] Continuation of Ser. No. 846,792, Mar. 5, 1992, abandoned.

[30] Foreign Application Priority Data

Mar. 6, 1991 [JP] Japan ..... 3-063726
Mar. 7, 1991 [JP] Japan ..... 3-067999
Mar. 8, 1991 [JP] Japan ..... 3-069250

[51] Int. Cl.[6] ..... H01J 1/02; H01J 19/10; H01J 43/00

[52] U.S. Cl. ..... 313/495; 313/497; 313/104; 313/309; 313/336; 313/351; 313/103 CM; 313/105 CM

[56] References Cited

U.S. PATENT DOCUMENTS 3,665,241 5/1972 Spindt et al. ..... 313/351
5,030,921 7/1991 Kane ..... 313/309

FOREIGN PATENT DOCUMENTS

0349425A1 1/1990 France ..... 313/496
1-294336 12/1987 Japan ..... H01J 37/06

*Primary Examiner*—Donald J. Yusko
*Assistant Examiner*—Matthew J. Esserman
*Attorney, Agent, or Firm*—Hill, Steadman & Simpson

[57] ABSTRACT

A flat display apparatus has a substrate, a plurality of pointed cathodes formed on the substrate, a planar anode facing toward the cathodes via a vacuum space, and a light emitting layer on the side of the anode which is opposite from the cathodes. The anode has a plurality of projections in positions corresponding to the cathodes. The anode projections reduce electron scatter to improve light emission from the light emitting layer. In another embodiment of the flat display apparatus, a plurality of electron sources are disposed on the substrate and positioned relative to one another in an alternately staggered vertical positional sequence toward a light emitting member so that electrons are successively amplified. In a further embodiment of the flat display apparatus, wherein a plurality of electron sources are disposed on the substrate, an electrode faces toward the electron sources, and a light emitting member is provided on a side of the electrode opposite and facing away from the substrate, the electron sources include a primary electron source for generating primary electrons and a secondary electron source for amplifying primary electrons from the primary electron source due to a malta effect.

10 Claims, 6 Drawing Sheets

FIELD EMISSION TYPE FLAT DISPLAY APPARATUS

This is a continuation, of application Ser. No. 07/846,792, filed Mar. 5, 1992, now abandoned.

BACKGROUND OF THE INVENTION (1) Field of the Invention

The present invention relates to a field emission type fiat display apparatus and in particular to a flat display apparatus in which a plurality of small pointed cathodes are used as electron emission sources.

(2) Description of the Prior Art

The use of a flat display apparatus which will be used in lieu of the currently and mainly used CRT for television receiver has been studied. The different types of flat display apparatus include a liquid crystal display (LCD), an electroluminescence display (ELD) and a plasma display panel (PDP). The field emission type of display has attracted attention in view of screen brightness.

The field emission type display apparatus will be briefly described herein. Conical cathodes of molybdenum having a diameter not larger than 1.0 μm are formed as electron emission sources on a substrate by the semiconductor manufacturing process. A flat gate electrode having apertures for each of the cathodes is formed on the side where the pointed ends of the cathodes are located. The gate electrode is separated from the pointed ends of the cathodes. A high voltage is selectively applied across the gate electrode and the cathodes. An elecrostatic field is thus induced to extract electrons from the cathodes. A given picture is displayed on a screen by irradiating with electron beams a light emitting layer (luminescence layer) disposed on the reverse side of an anode. Such a field emission type display apparatus is described in, for example, U.S. Pat. No. 3,665,241 and Japanese Unexamined Patent Publication No. Hei 1-294336.

FIG. 1 is a sectional view showing an example of a prior art field emission type display apparatus. A plurality of pointed cathodes 2 are formed on a substrate 1. A gate electrode 4 is formed on an insulating film 3 formed on the substrate 1. Electrons are liberated and extracted from the cathodes by a voltage applied across the gate electrode 4 and the cathodes 2. The gate electrode 4 has an aperture 4*a* above each of the cathodes 2. Electron beams from the cathodes 2 pass through the apertures 4*a* and collide with a flat anode 5 facing to the substrate 1 and to which a high voltage is applied. The electrons reach a light emitting layer 6 on the reverse side of the anode 5 so that the layer 6 emits light.

The dimensions of the display apparatus are as follows. The diameter of the gate is about 1 μm. The curvature radius of the pointed ends of the cathodes is 50 μm. Molybdenum or tungstsen is used as a material for these components. The spacing between the cathodes and the anode is 200 μm. A voltage of 300 volts is applied thereacross. The drive voltage of the gate is 40 volts.

In such a field emission type display apparatus, the beams of electrons emitted from the pointed cathodes tend to scatter. The intensity of the light emitted from the light emitting layer 6 is not enough.

The causes of scattering of the electron beams will be described with reference to FIG. 2, which is an enlarged FIG. 1. FIG. 2 shows the distribution of the potential between the substrate and the anode. When a desired voltage is applied to the gate 4, the equipotential surfaces E are curved toward the anode. This is referred to as an electrostatic field lens. The electrons $e^-$ are subjected to forces in a direction normal to the equipotential surfaces E. Therefore, the electrons are scattered. The electrons which have been scattered in such a manner are incident upon an anode 5 and reach at a light emitting layer 6 on the reverse side of the anode 5. Therefore, the intensity of the light emitted from the layer 6 is lowered.

SUMMARY OF THE INVENTION

It is a first object of the present invention to provide a planar anode with projections in positions corresponding to cathodes for increasing the intensity of light emitted from a light emitting layer, It is a second object of the present invention to provide, a plurality of electron sources for successively amplifying electrons.

It is a third object of the present invention to provides a number of electrons by amplifying the electrons emitted from a primary electron source by the Malta effect.

DESCRIPTION OF THE PREFERRED EMBODIMENTS

A first preferred embodiment of the present invention will be described with reference to the drawings.

Figure 5:
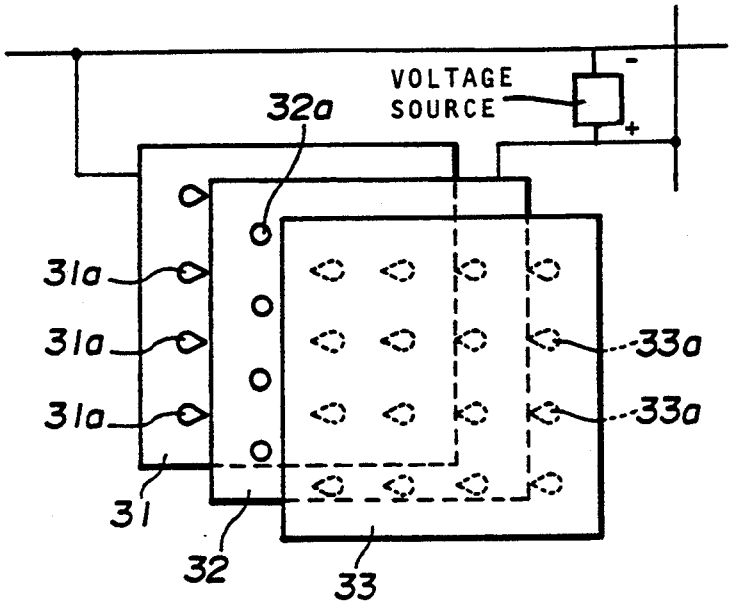
FIG. 5 is a schematic view showing the relationship among electrodes of the first embodiment of a field emission type image display apparatus of the present invention shown in FIG. 3.

FIG. 5 is a schematic view showing a part of a flat display apparatus of the present embodiment. The display apparatus comprises a cathode voltage supply unit 31 and a gate electrode 32 which are partitioned for each pixel and form an XY matrix which is to be scanned. The cathode voltage supply unit 31 is formed with a plurality of cathodes 31*a*, each of which emits electron beams. The gate electrode 32 has apertures 32*a* in positions corresponding to the positions of the cathodes 31*a*. The gate electrode 32 is disposed in a close relationship with the cathodes 31*a*. The electron beams pass through the apertures 32*a* of the gate electrode 32. A flat planar anode electrode 33 is disposed on one side of the gate electrode 32 which is opposite to the cathode voltage supply unit 31. In the present embodiment, the anode electrode 33 is formed with projections 33*a* corresponding to the cathodes 31*a*. An electrostatic field converged by the projections 33*a* to prevent the electric beams from being scattering.

The voltage of each electrode in the present embodiment will be described. A voltage which is about several volt, s is applied across the cathodes 31*a* and the gate electrode 32. A voltage which is about several hundred volts is applied across the cathodes 31*a* and the anode electrode 33. Accordingly, the electron beams are emitted by a voltage between the cathodes 31*a* and the gate electrode 32, and the emitted electron beams are directed toward the anode electrode 33 by the potential of anode electrode 33. Since the anode electrode 33 is formed with the projections 33*a* as mentioned above, the electron beams are converged toward the projections 33*a* so that the light, emitting layer located on the opposite side of the projections 33*a* emits light at a high efficiency.

Figure 4:
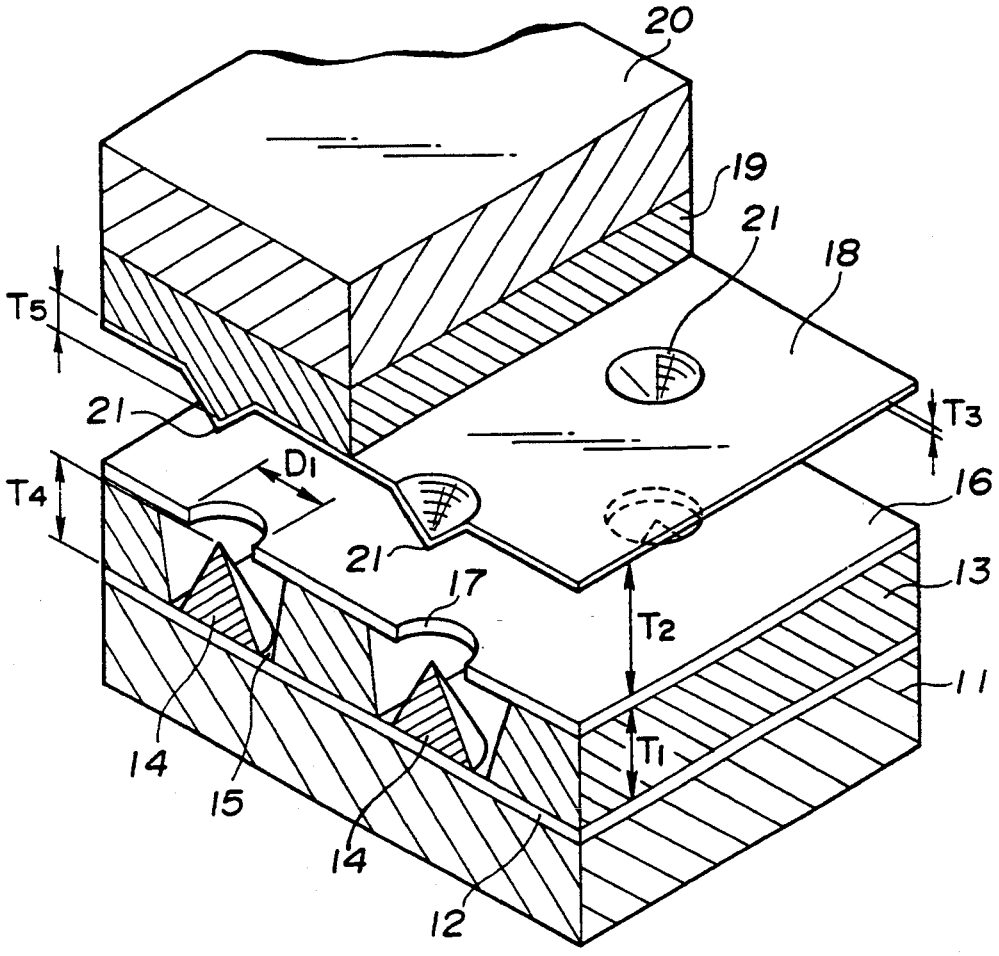
FIG. 4 is an enlarged partly sectional and perspective view showing the substrate and the light emitting layer of the first embodiment of the present invention shown in FIG. 3.

The structure of the present embodiment will be described with reference to FIG. 4. A flat display apparatus in the present embodiment comprises a substrate 11 and a cathode voltage supply layer 12 made of an electrically conductive material. A silicon oxide film 13 which is insulating is formed on the cathode voltage supply layer 12. The thickness $T_1$ of silicon oxide film 13 is about 1 μm. The silicon oxide, film is formed with a plurality of recesses 15 so that the cathode voltage supply layer 12 is exposed on the bottom of the film 13. A small cathode 14 having a conical pointed shape is formed in each of the recesses 14. Each cathode 14 is formed of a metal such as tungsten and molybdenum. The pointed shape of the cathodes 14 is formed by using the oblique incident evaporation process or lift-off process. The cathodes 14 are preferably arranged on the cathode voltage supply layer 12 in a two-dimensional matrix pattern. The pointed cathodes 14 are equilaterally triangular in a section which is perpendicular to the main face of the substrate. The height $T_4$ from the bottom to the apex of the cathodes 14 is about 0.5 μm.

A thin gate electrode layer 16 is formed on the silicon oxide film 13. The gate electrode layer 16 is formed with a plurality of through-holes 17 in a two-dimensional matrix in positions corresponding to the positions of the cathodes 14. The diameter $D_1$ of the through-holes 17 is about 1 μm. Since the diameter $D_1$ of the through-holes 17 formed in the gate electrode layer 16 is smaller than the diameter of the recesses 15 of the silicon oxide film 13, the gate electrode layer 16 extends in an inner radial direction over the recesses 15.

The anode which faces via a vacuum space toward the above mentioned cathode comprises a planar anode 18, a light emitting layer 19 made of a light emitting material formed on one side of the anode 18 which is opposite from the substrate side, and a front panel glass 20 provided on the side of the light emitting layer 19 opposite from the anode 18. The length $T_2$ of the vacuum space between the gate electrode layer 16 and the anode 18 is about 1 mm. The cathode and the anode face toward each other so that the vacuum space is disposed therebetween. Electron beams from the cathodes 14 reach to the anode 18. The vacuum pressure in the vacuum space is, for example, about $10^{-9}$ Tort.

The anode 18 is made of a planar aluminum thin film. In the present embodiment, projections 21 are arranged in a two-dimensional matrix in positions corresponding to the pointed conical cathodes 14. Each projection 21 is conical in shape and has an apex facing to the apex of the relevant cathode 14. The anode 18 has a substantially constant film thickness $T_3$, which is about 100 Å. The length $T_5$ of the projections 21 is, for example, about 1 μm. The diameter of the projections 21 is not limited to that smaller than that of the cathodes 14 and may be larger than that of the cathode 14. The shape of the projections 21 is not limited to conical as shown in the drawing and may be pyramidal, semi-spherical or a small square-pillar. Although the projections 21 correspond to the cathodes 14 one by one in the present embodiment, the present invention is not limited to this. One projection may correspond to a plurality of cathodes or the projections 21 may be formed of a different material.

The light emitting layer 19 having a required thickness is formed on the anode 18. The light emitting layer 19 is irradiated with the electron beams which are emitted and transmitted through the anode 18 so that the light emitting layer 19 emits light. The front panel glass 20 made of a transparent material is formed on the light emitting layer 19. An image displayed by the apparatus of the present embodiment is displayed through the front panel glass 20 by the emission of lights from the light emitting layer 19.

Figure 1:
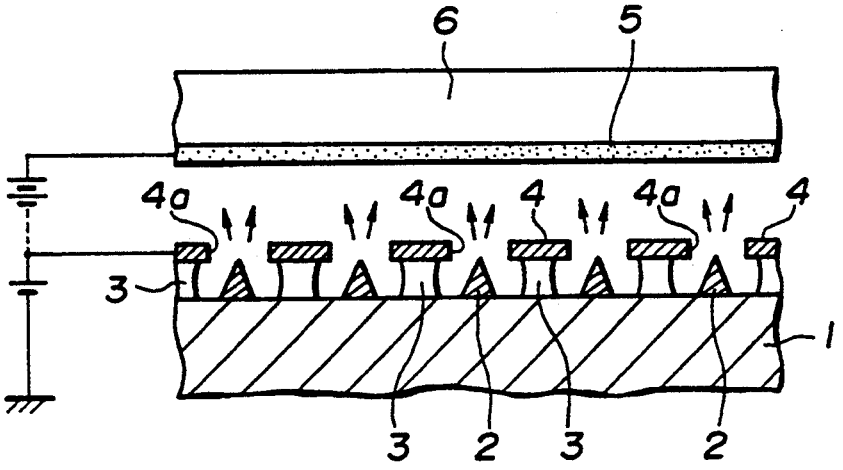
FIG.1 (PRIOR ART)
FIG. 1 is a schematic sectional view showing an example of a prior art field emission type display apparatus.
Figure 2:
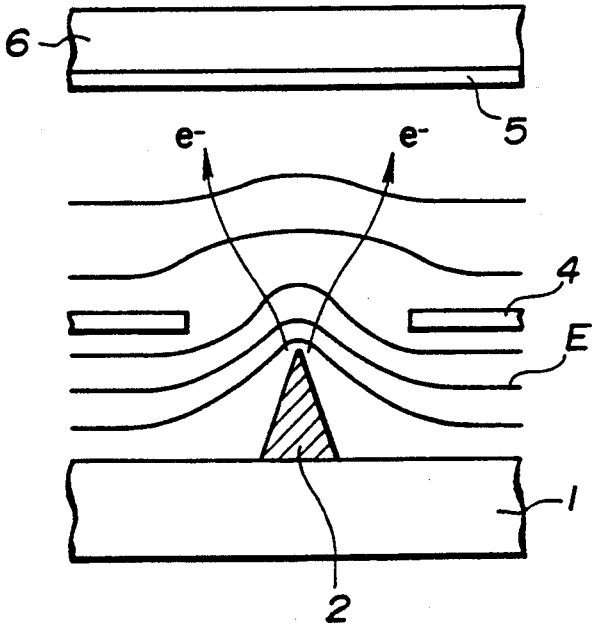
FIG.2 (PRIOR ART)
FIG. 2 is a sectional view showing an enlargement of the prior art shown in FIG. 1.
Figure 3:
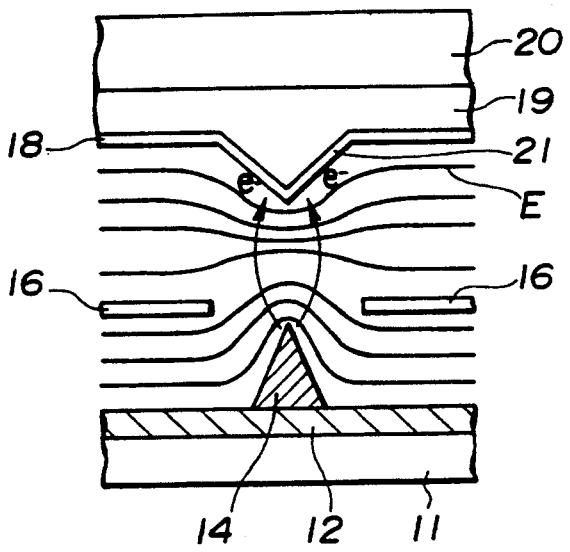
FIG. 3 is a sectional view showing the structure and the electrostatic field around a cathode and a projection in a first embodiment of a field emission type display apparatus of the present invention.

Suppression of the scattering of the electron beams in the anode 18 having projections 21 of the present embodiment will be described with reference to FIG. 3. FIG. 3 corresponds to FIG. 4 showing a prior art structure. The anode 18 is electrically conductive since it is made of an aluminum thin film. Therefore, the anode 18 is at an equipotential which is about several hundred volts higher than the potential of the cathode 14. The equipotential curve E is changed depending upon the shape of the projections 21 by projecting the projections 21 beyond the surface of the anode 18 toward the cathode 14, and the potential gradient becomes high on the shortest line between the apexes of the cathodes 14 and the projections 21. As a result of this, even elections e which are otherwise scattered will be converged toward the projections 21 of the anode 18 so that the intensity of the impinged electrons increases by the electrostatic field effect. The increase in the intensity of the electron beams increases the intensity of light emitted from the light emitting layer 19 so that the brightness of the displayed image is increased to provide a sharp picture.

The flat display apparatus of the present invention includes projections each corresponding to one pointed cathode, and which are formed on the anode. The electrostatic field in the vicinity of the projection is concentrated by the projection so that the electron beams generated from the cathodes are suppressed from being scattered. As a result of this, the intensity of the light emitted from the light emitting material is increased to provide a sharp picture.

The first embodiment has been described with reference to the anode structure thereof. The object of the present invention can be accomplished by increasing the electron beams from the cathode to increase the intensity of the emitted lights. An electron source in the side of the cathode will be mainly considered.

A second preferable embodiment of the present invention will be described with reference to the drawings. A flat display apparatus of the present embodiment comprises a plurality of electron sources and is capable of emitting a number of electrons and of irradiating a light emitting layer with them.

Figure 6:
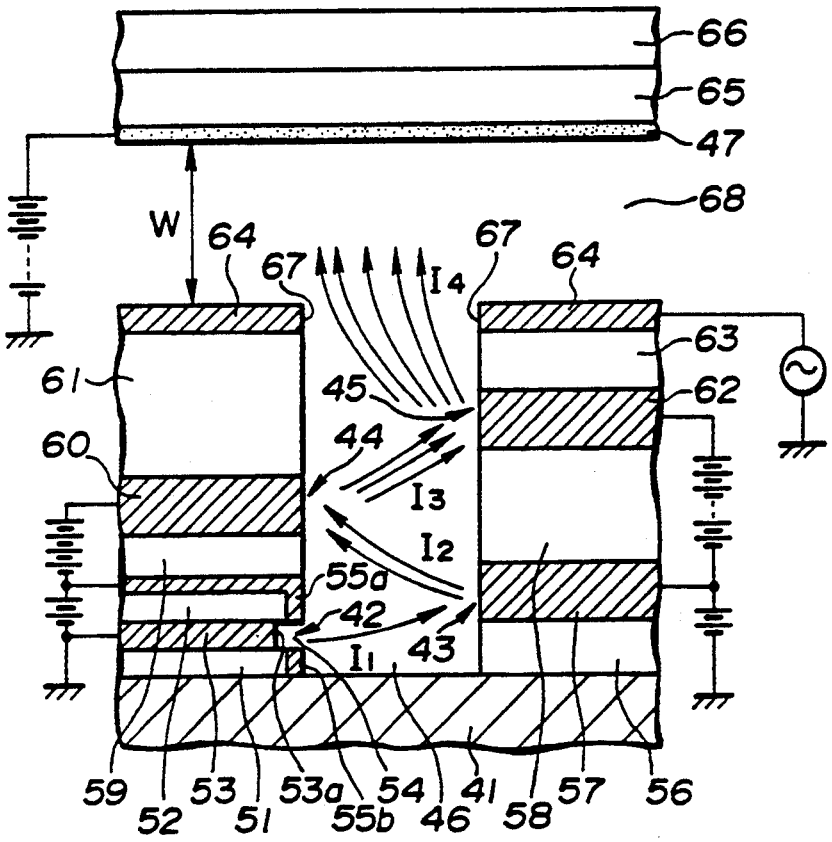
FIG. 6 is a schematic sectional view showing a second embodiment of a field emission type display apparatus of the present invention.

FIG. 6 is a schematic sectional view showing a second embodiment of a flat display apparatus of the present invention. Primary to quartenary electron sources 42 to 45 are formed on a substrate 41 in a multilayered manner. The primary to quaternary electron sources 42 to 45 are separated into odd numbered electron sources 42 and 44 and even numbered; electron sources 43 and 45 by a vacuum space 46, and face to each other so that the vacuum space 46 is disposed therebetween. The primary to quaternary electron sources 42 to 45 are disposed so that the degree increases from the substrate to the anode 47 made of aluminum, The primary electron source 42 has a cathode 53 made of a metal such as molybdenum or tungsten sandwiched between interlayer insulating films 51 and 52 made of silicon oxide film. The cathode 53 is electrically grounded. The cathode 53 is preferably in a sawtoothed shaped at the tip end 53*a* thereof so that the electrostatic field is concentrated. The cathode 53 is opened at the tip end 53*a* thereof so that electrons are emitted through an opening 54. Attracting electrodes 55*a* and 55*b* are located in the vicinity of the interface between the opening 54 and the vacuum space 46. Electrons are attracted from the cathode 53 by applying a voltage across the electrodes 55*a* and 55*b* and the primary electrons I are directed into the vacuum space 46.

The secondary electron source 43 faces to the primary electron source 42 via the vacuum space 36 and is located between the substrate 41 and the anode 47 and is slightly closer to the anode 47 than the primary electron source 42. The secondary electron source 43 comprises an electron source layer 57 made of cesium oxide or magnesium oxide and interlayer insulating films 56 and 58 which sandwich the electron source layer 57. A necessary positive voltage is applied to the electron source layer 57. The electron source layer 57 is irradiated with the primary electrons 11 emitted from the primary electron source 42 on the side of the layer 57 open to the vacuum space 46. As a result of this, amplified secondary electrons $I_2$ are emitted from the electron source layer 57.

The tertiary electron source 44 faces toward the secondary electron source 43 via the vacuum space 46 and is formed above the primary electron source 42 on the substrate 41, i.e. in a position closer to the anode 47 than that of the secondary electron source 43. The tertiary electron source 44 comprises an electron source layer 60 made of cesium oxide or magnesium oxide and interlayer insulating films 59 and 61 which sandwich the electron source layer 60 therebetween. A voltage which is higher than a voltage applied to the electron source layer 29 of the secondary electron source 43 is applied to the electron source layer 60 of the tertiary electron source 44. The electron source layer 60 is irradiated with the secondary electrons $I_2$ from the secondary electron source 43 on the side of the layer facing toward the vacuum space 46. Accordingly, the tertiary electrons $I_3$ which are amplified from the secondary electrons $I_2$ are emitted into the vacuum space 46 from the electron source layer 60 of the tertiary electron source 60 of the tertiary electron source 44.

The quaternary electron source 45 is disposed at the side where the secondary electron source 43 is located, of the vacuum space 46 and faces toward the tertiary electron source 44 via the vacuum space 46. The quaternary electron source 45 is formed with an electron source layer 62 made up of cesium oxide or magnesium oxide. The electron source layer 62 of the quaternary electron source 45 is closer to the anode 47 than the tertiary electron source 44. An interlayer insulating film 63 is formed at the side of the electron source layer 62 facing toward the anode 47 so that the electron source layer 62 is sandwiched between the interlayer insulating films 58 and 63, A voltage which is higher than a voltage applied to the electron source layer 60 of the tertiary electron source 44 is applied to the electron source layer 62 of the quaternary electron source 45. The electron source layer 62 is irradiated with the tertiary electrons $I_3$ from the tertiary electron source 44 on the side of the layer facing toward the vacuum space 46, similar to the tertiary and secondary electron source 43 quaternary electrons $I_4$ which are amplified from the tertiary electrons $I_3$ and emitted into the vacuum space 46 from the electron source layer 62 of the tertiary electron source 45, A gate electrode 64 is disposed on the sides of interlayer insulating films 61 and 63 facing toward the anode 47 for controlling the irradiation of the anode 47 with the quaternary electrons $I_4$ by the electrostatic field established by the electrode 64. When a high voltage is applied to the gate electrode 64, the anode 47 is irradiated with the quaternary electrons $I_4$. When a low voltage is applied to the electrode 64, the anode 47 is not irradiated with the quaternary electrons $I_4$.

The gate electrode 64 is formed with an opening 67 through which the vacuum space 46 which is disposed between the electron sources 42 to 44 extends to the anode 47. If electron sources each including a plurality of electron sources 42 to 44 are disposed in a two-dimensional matrix manner on the substrate 41, the openings 67 are correspondingly disposed in a two-dimensional matrix manner.

The anode 47 is disposed apart from the gate electrode 64 by a distance, so that a vacuum space 68 is disposed therebetween. The anode 47 comprises an aluminum thin film having a face which is parallel with the main face of the substrate 41. A high voltage is applied to the anode 47. The anode 47 is about 100 Å in thickness. The electrons reach at the anode 47 from the electron sources depending upon the electrostatic field established by the thin anode 47 and penetrate to the light emitting layer 65 formed on the opposite side of the anode 47. A number of electrons which have been significantly amplified by the plurality of electron sources 42 to 45 collide with the light emitting layer 65 formed on the side of the anode which is opposite from the substrate 41 so that the layer 65 intensively emits light. A front panel glass 66 is formed on the side of the light emitting layer 65 opposite from the anode 47. A sharp picture imaged by the light emitted from the light emitting layer 65 is displayed through the front panel glass 66.

In the flat display apparatus of the present embodiment having such a structure, a voltage which is higher by 50 to 100 volts than that applied to the primary electron source 42 is applied to the secondary electron source 43; a voltage which is higher by 50 to 100 volts than that applied to the secondary electron source 43 is applied to the tertiary electron source 44; and a voltage which is higher by 50 to 100 volts than that applied to the tertiary electron source 44 is applied to the quaternary electron source 45. Electrons are successively amplified by each of the electron sources to which stepwise higher voltages are applied on each strike thereon, and are successively fed toward the anode 47 through the vacuum space 46.

The energy of the electrons at this time is about 50 to 100 eV. The electrons emitted from the quaternary electron source 45 strike the anode depending upon the voltage applied to the gate electrode 64. Since the number of the electrons is increased more than 10 times at each of the electron sources, the quaternary electrons 14 emitted from the quaternary electron source 45 establish electron beams having a sufficient intensity. Accordingly, the light emitting layer 45 emits light having a high intensity so that a sharp picture can be displayed at a high brightness.

In the above mentioned embodiment, a plurality of electron sources are arranged so that the electron sources face toward each other and higher voltage are applied to the electron sources as they approach toward the anode 47. The present invention is not limited to this arrangement. For example, a plurality of electron sources may be arranged on a plane so that electrons travel along arches between sources and are amplified in each of the electron sources and finally collide with the anode. Although the number of the electron sources is four, it may be 3, 5, 6 or the other numbers.

In the flat display apparatus of the present invention, the electrons are amplified on each striking of the electron source. Therefore, the light emitting layer can be irradiated with very strong electron beams. Accordingly, enough intensity of light can be obtained so that a sharp picture is displayed.

A third preferable embodiment of the present invention will be described with reference to the drawings.

Figure 7:
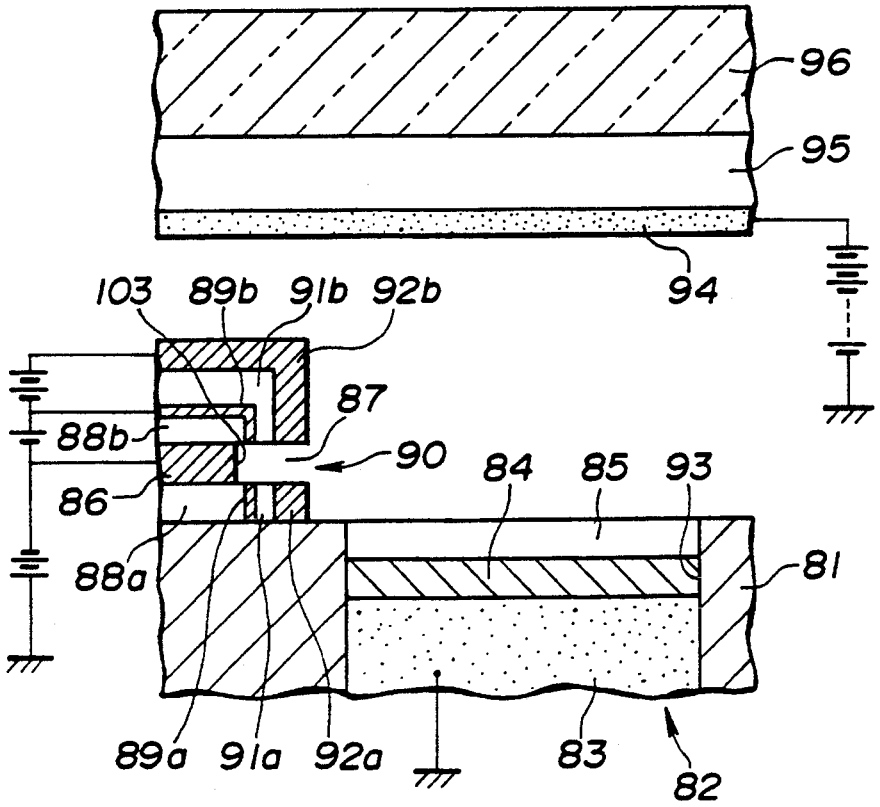
FIG. 7 is a schematic sectional view showing a third embodiment of a field emission type display apparatus of the present invention.

The third embodiment is a flat display apparatus using the Malta effect for generating secondary electrons. FIG. 7 shows an essential part of the display apparatus. A secondary electron source 82 is formed on a part of a substrate 81 made of an insulating material.

The secondary electron source 82 comprises a laminate formed in a recess 93 which is formed in the substrate 81. The laminate includes an aluminum film 83, a thin aluminum oxide film 84 laminated on the aluminum film 83 and a cesium oxide film 85 laminated on the aluminum oxide film 84. The lowermost aluminum film 83 is at ground potential. The aluminum oxide 84 formed between the aluminum film 83 and the cesium oxide film 85 is a thin film having a thickness of 500 to 1000 Å. A number of electron beams are emitted from the secondary electron source by a mechanism which will be described hereafter.

Figure 8:
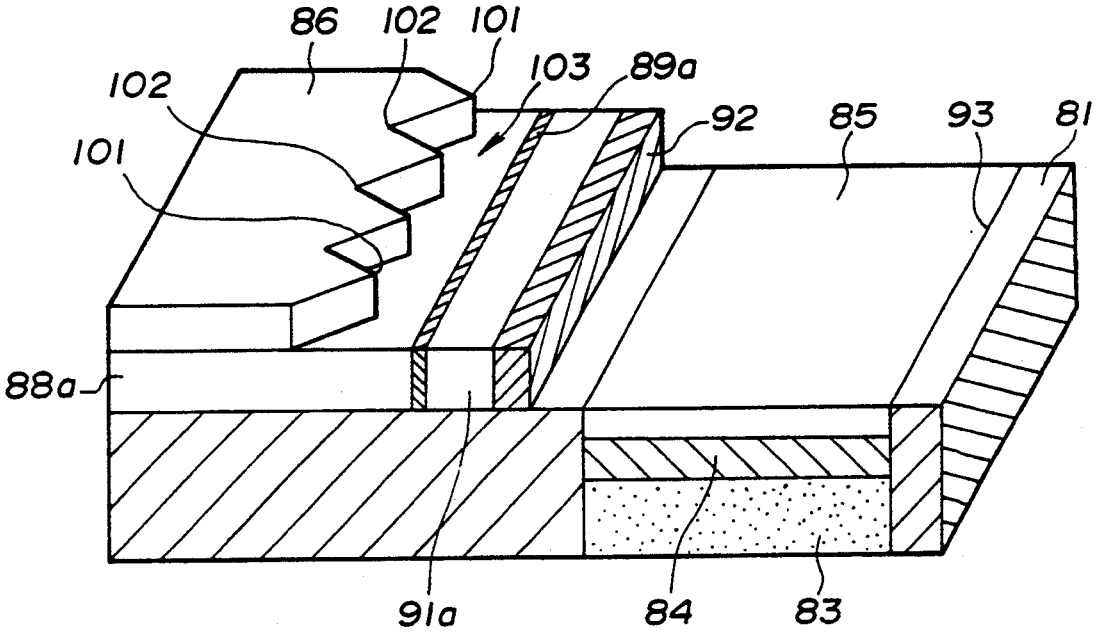
FIG. 8 is a sectional and perspective view showing the shape of a cathode of the field emission type display apparatus, which is the third embodiment shown in FIG. 7.

A primary electron source 90 is formed on the substrate 11 in the vicinity of the laminate including three metal and metal oxide films. The primary electron source 90 includes a cathode 86 having a saw-tooth shaped electrostatic field generating source, which serves as an electron emitting source. FIG. 8 is a perspective view showing the shape of the cathode 86. The cathode 86 is formed into a flat member on a lower insulating film 88*a* and is made of a metal such as molybdenum or tungsten. The electrostatic field generating side of the cathode 86 is saw-tooth in shape that it has threads 101 and bottoms 102 which are alternately disposed. The electrostatic field is concentrated at the threads 101 to extract the primary electrons. The cathode 86 is sandwiched between the lower and upper insulating films 88*a* and 88*b* and an opening 87 is formed in the side of the electrostatic field generating side 103.

Upper and lower extracting electrodes 89*b* and 89*a* and upper and lower accelerating grids 92*b* and 92*a* face to each other in the opening 87. The upper extracting electrode 89*b* is disposed at one end of the upper insulating film 88*b* facing toward the secondary electron source, under which the cathode 86 is disposed. The lower extracting electrode 89*a* is disposed at one end of the lower insulating film 88*a* facing toward the secondary electron source, on which the cathode 86 is disposed. The upper and lower extracting electrodes 89*b* and 89*a* are disposed in the vicinity of the electrostatic field generating side 103 of the cathode 86. The primary electrons are extracted from the cathode 86 by applying a necessary voltage upon the upper and lower extracting electrode 89*b* and 89*a*. The lower accelerating guide 92*a* is disposed on the main face of the substrate 81 so that the lower interlayer insulating film 91*a* is sandwiched between the lower extracting electrode 89*a* and the lower accelerating grid 92*a*. The upper accelerating grid 92*b* is disposed so that the upper interlayer insulating film 91*b* is sandwiched between the upper interlayer insulating film 91*b* and the upper accelerating grid 92*b*. The upper and lower accelerating grids 92*b* and 92*a* have a film thickness which is larger than those of the extracting electrodes 89*b* and 89*a*. A voltage which is higher than that applied to the extracting electrodes 89*b* and 89*a* is applied to the upper and lower accelerating grids 92*b* and 92*a* for accelerating the primary electrons in the opening 87. The energy which is given to the primary electrons is about 50 to 100 eV.

An anode 94 is disposed so that it faces toward the substrate 81 on which the primary and secondary electron sources 90 and 82 are adjacent to each other. A vacuum space is disposed between the substrate 81 and the anode 94. The main face of the substrate 81 is disposed substantially parallel with the planar anode 94. A high voltage is applied to the anode 94 so that a number of electrons generated by the secondary electron source 82 reaches the anode 94. A light emitting layer 95 is provided on the side of the anode 94 which is opposite from the vacuum space. Electrons strike the light emitting layer 95 for emitting light. The light emitting layer 95 is sandwiched between the anode 94 and the front panel glass 96. The front panel glass 96 is made of a transparent glass and a picture is displayed through the front panel glass 96.

In the embodiment of the flat display apparatus having such a structure, primary electrons are extracted from the cathode 86 to the opening 87 by applying a voltage across the cathode 86 and the extracting electrodes 89*a* and 89*b*. The primary electrons are accelerated by the upper and lower accelerating grids 92*b* and 92*a*. The accelerated primary electrons are obliquely incident upon the surface of the cesium oxide 85 to emit secondary electrons outside thereof. As a result of emission of the secondary electrons in such a manner, the cesium oxide 85 is positively charged. Then, this will establish an electrostatic field upon the aluminum oxide film 84 which functions as a dielectric material. Since the aluminum oxide film 84 is a very thin film, a strong electrostatic field is established in vicinity of the aluminum oxide film. A number of electrons are extracted from the aluminum film by this strong electrostatic field (Malta effect) and are accelerated in accordance with electrostatic field between the film 84 and the anode 94.

Many electrons which have reached at the anode 95 will reach the light emitting layer 95 to emit lights there from. The number of the electrons is so high that the intensity of emitted light is high.

The present embodiment of the flat display apparatus uses the Malta effect to cause many electrons to collide with the light emitting layer 95. Accordingly, the intensity, of the emitted light for displaying the image can be remarkably enhanced as mentioned above. Although the secondary electron source is a laminate film including the cesium oxide film 85, the aluminum oxide film 84 and the aluminum film 83 in the present embodiment of the image display apparatus, the secondary electron source is not limited to only this laminate film. It may be a laminate film including a magnesium oxide, a nickel oxide film and a nickel film.

Figure 9:
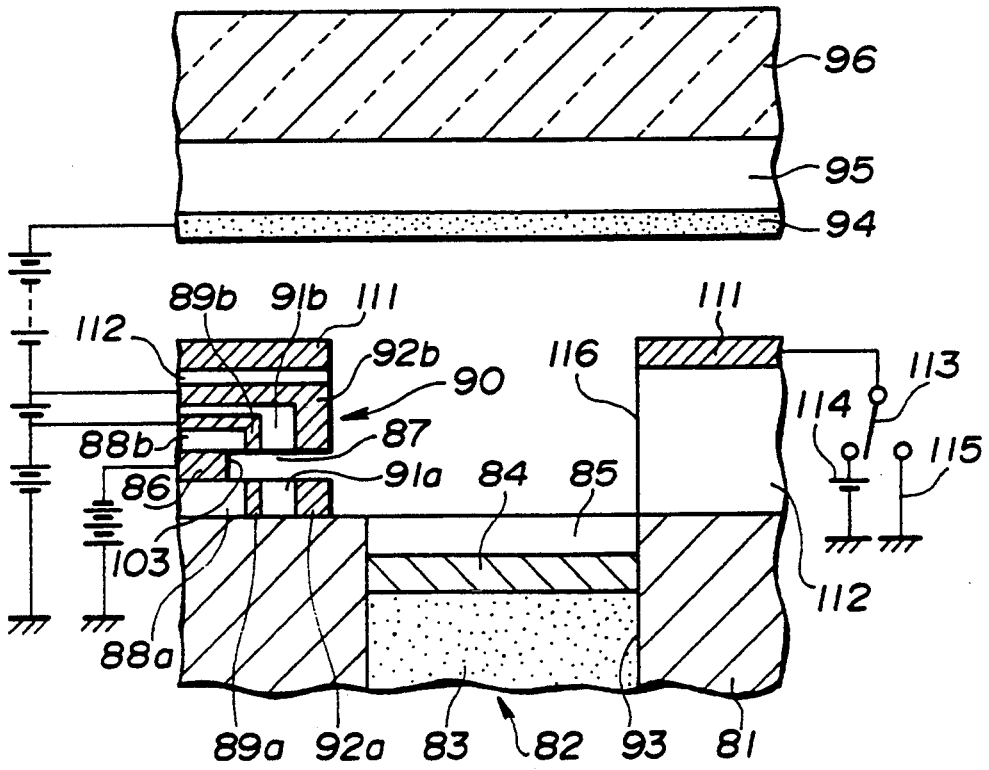
FIG. 9 is a schematic sectional view showing a fourth embodiment of a field emission type display apparatus of the present invention.

A fourth embodiment of the present invention will be described. A flat display apparatus of the present embodiment has a gate electrode as shown in FIG. 9.

The fourth embodiment is substantially identical with the third embodiment, except that the image display apparatus of the present embodiment is formed with a gate electrode 111. Like parts are designated with like numerals. A duplicated description of similar parts will be omitted herein.

The gate electrode 111 is formed on an interlayer insulating film 112 which is formed on a substrate 81 and an upper accelerating grid **92*b*. The interlayer insulating film 112 and the gate electrode 111 are opened above a secondary electron source 82 for controlling the electrons passing through the opening 116 from the secondary electron source 82. The potential of the gate electrode 111 is controlled by a switch 113. The switch 113 switches the potential of the gate electrode 111 to that of a ground terminal or that of a terminal 114 of a necessary voltage. When the potential of the gate electrode 111 becomes the ground potential, the electrons from the secondary electron source 82 are interrupted. When the potential of the gate electrode 111 becomes a necessary positive voltage, the electrons from the secondary electron source 82 pass through the gate electrode to collide with a light emitting layer 95**.

Addition of such a gate electrode 111 enables a number of electrons emitted from the secondary electron source 82 due to Malta effect to be controlled. Similarly to the third embodiment, the intensity of emitted light for image display can be remarkably enhanced. Accordingly, a sharp and highly bright picture can be provided.

Also in the fourth embodiment, the laminate film in which the Malta effect occurs may be a laminate including a magnesium oxide film without limiting it to a laminate film including a cesium oxide film, an aluminum oxide film and an aluminum film.

The flat display apparatus of the present invention can irradiate a light emitting layer in the opposite side of an electrode (anode) with a number of electrons emitted from a secondary electron source which are amplified electrons from a primary electron source due to the Malta effect as mentioned above. Accordingly, the intensity of the emitted light for displaying a picture can be remarkably enhanced. A sharp image having a high brightness can be provided. Addition of a gate electrode enables a number of electrons from a secondary electron source to be positively controlled. The present invention contributes to provide a sharp picture having a high brightness by increasing the intensity of light emitted from a light emitting layer.

What is claimed is:

1. A flat display apparatus, comprising:

a substrate;

a plurality of separate pointed cathodes formed on said substrate;

a planar anode facing toward said cathodes via a vacuum space;

a light emitting member on a side of said planar anode which is opposite and facing away from said cathodes; and said planar anode having a plurality of conical shaped projections extending therefrom in positions corresponding to and aligned with said pointed cathodes, a separate projection being provided for each separate cathode.

2. A flat display apparatus, comprising:

a substrate;

a plurality of electron sources disposed on said substrate;

an anode facing toward said electron sources via a vacuum space;

a light emitting member on a side of said anode which is opposite and facing away from said substrate; and said plurality of electron sources being positioned relative to one another in an alternately staggered vertical positional sequence toward said light emitting member such that electrons are successively amplified by each of said electron sources and are incident upon the light emitting member, said electron sources forming opposing sidewalls of a portion of said vacuum space.

3. A flat display apparatus, comprising:

a substrate;

a plurality of electron sources disposed on said substrate;

an electrode facing toward said electron sources via a vacuum space;

a light emitting member provided on a side of said electrode which is opposite and facing away from said substrate; and said electron sources including a primary electron source for generating primary electrons and a secondary electron source for amplifying primary electrons from said primary electron source due to a Malta effect.

4. A flat display apparatus according to claim 3 in which said secondary electron source includes a laminate film of a cesium oxide film, an aluminum oxide film and an aluminum film.

5. A flat display apparatus according to claim 3 in which said secondary electron source includes a laminate film of a magnesium oxide film, a nickel oxide film and a nickel film.

6. A flat display apparatus according to claim 3 in which a gate electrode for controlling a beam of electrons emitted toward the electrode is provided between said electron sources and said electrode.

7. A flat display apparatus according to claim 1 in which a gate electrode for controlling a beam of electrons emitted toward the planar anode is provided between said pointed cathodes and said planar anode.

8. A flat display apparatus according to claim 1 wherein each of said conical projections is pointed and has an apex position directly above a point of a corresponding cathode.

9. A flat display apparatus according to claim 3 wherein the primary electron source comprises a cathode having a sawtooth shape.

10. A flat display apparatus according to claim 3 wherein said primary electron source is arranged alongside the secondary electron source and wherein a gate electrode is arranged above the primary electron source and the secondary electron source with an aperture therein beneath which lies said secondary electron source.

* * * * *

Disclaimer 5,378,963 —Rikio Ikeda, Kanagawa, Japan. FIELD EMISSION TYPE FLAT DISPLAY APPARATUS. Patent dated January 3, 1995. Disclaimer filed May 16, 1995, by the assignee, Sony Corporation.

Hereby enters this disclaimer to claim 2 of said patent.

(*Official Gazette* September 5, 1995.)